US008853574B2

(12) United States Patent
Christophy et al.

(10) Patent No.: US 8,853,574 B2
(45) Date of Patent: Oct. 7, 2014

(54) ELECTROMECHANICAL SLIDE SWITCH

(76) Inventors: Miguel C Christophy, San Francisco, CA (US); Daniel W Jarvis, Sunnyvale, CA (US); Richard H Dinh, Santa Clara, CA (US)

( * ) Notice: Subject to any disclaimer, the term of this patent is extended or adjusted under 35 U.S.C. 154(b) by 264 days.

(21) Appl. No.: 13/541,623

(22) Filed: Jul. 3, 2012

(65) Prior Publication Data

US 2014/0008192 A1 Jan. 9, 2014

(51) Int. Cl.
*H01H 9/04* (2006.01)

(52) U.S. Cl.
USPC ..... 200/302.1

(58) Field of Classification Search
CPC ..... H01H 9/04; H01H 9/00; H01H 13/06; H01H 9/042; H01H 21/08; H01H 2223/002; H01H 9/02; H01H 71/08; H01H 13/04
USPC ..... 200/302.1
See application file for complete search history.

(56) References Cited

U.S. PATENT DOCUMENTS 2,723,328 A * 11/1955 Verkuil ..... 200/302.2
4,803,380 A * 2/1989 Jacoby et al. ..... 307/157
2013/0292235 A1* 11/2013 Baum et al. ..... 200/302.2

* cited by examiner

*Primary Examiner* — Edwin A. Leon
(74) *Attorney, Agent, or Firm* — Womble Carlyle Sandridge & Rice, LLP

(57) ABSTRACT

Electromechanical slide switches are provided. The electromechanical slide switches can include conductive components that are configured to change position relative to one another in response to a mechanical input. The electromechanical slide switch can include a number of cooperating intrusion barriers that combine to prevent intrusion of external agents, such as water or dust.

23 Claims, 4 Drawing Sheets

ELECTROMECHANICAL SLIDE SWITCH

BACKGROUND OF THE INVENTION

1. Field of the Invention

The described embodiments relate generally to electronic devices. More particularly, the present embodiments relate to providing protection against moisture intrusion.

2. Description of the Related Art

In recent years, small form factor consumer electronic products such as media players and cellular phones have become smaller, lighter and yet more capable by incorporating more powerful operating components into smaller and more densely packed configurations. This reduction in size and increase in density can be attributed in part to the manufacturer's ability to fabricate various operational components such as processors and memory devices in ever smaller sizes while increasing their power and/or operating speed. However, this trend to smaller sizes and increase in component density and power poses a number of continuing design and assembly challenges.

For example, small form factor consumer electronic products, such as a media player, can require the assembly of a number of components into an enclosure having an extremely small volume. Assembling the various components into the housing having such a small size can require complex, expensive, and time consuming assembly techniques. Moreover, aesthetic considerations can severely restrict the placement, size, and number of components used in the manufacture of the small form factor consumer electronic product. For example, proper alignment of external features such as buttons can be extremely difficult to accomplish when the small size of the consumer electronic device itself can severely reduce the available tolerance stack of the assembled components.

Yet another design challenge is insuring that the assembled components that are visible maintain their aesthetic look and "feel" over an expected operating lifetime and under anticipated environment operating conditions of the consumer electronic product. One component that can be visible on a consumer electronic product is a switch. Typically, a switch, such as an electromechanical slide switch, can be user actuated to provide operational inputs for controlling a device. For electromechanical slide switches, it is desirable that, over the expected lifetime of the device, 1) the switch maintains operable for its intended purpose, i.e., a proper input is generated according to the switch position, and 2) the "feel" of the switch is maintained, i.e., it moves smoothly from position to position in the manner for which it was designed and does not stick.

An environmental condition that can cause an electromechanical slide switch to deviate from its intended operational performance is moisture intrusion. Moisture intrusion can facilitate the build-up of oxides on metal components or the deposition of particulates within the switch that can affect the switch's electrical outputs and the feel of the switch during actuation. For small, high-density components with limited operational tolerances, preventing moisture intrusion can be difficult.

Thus, in view of the foregoing, there is a need for improved techniques for preventing intrusion in consumer electronic products while maintaining a favorable user experience.

SUMMARY OF THE DESCRIBED EMBODIMENTS

Broadly speaking, the embodiments disclosed herein describe an electromechanical slide switch well suited for use in electronic devices, such as laptops, cellphones, netbook computers, portable media players and tablet computers. The electromechanical slide switch can provide protection against the intrusion of external agents such as moisture or dust into areas where sensitive electrical components reside. In this way, immediate system failures due to shorts or more long term system failures due to corrosion of sensitive electrical contacts can be avoided or eliminated entirely. The protection against moisture intrusion can be maintained while immersed in water at depth.

In one embodiment, an electromechanical slide switch is described. The electromechanical slide switch includes at least a sliding body portion that, in turn, includes an external button feature accessible to a user for applying a sliding force to the sliding body portion. The sliding body portion is coupled to an electrical switch having an electrical contact that completes an electrical connection in a first position and breaks the electrical connection in a second position in response to the application of the sliding force. The electromechanical slide switch also includes a bracket configured for securing the sliding body portion and the electrical switch to an enclosure, a first barrier disposed between the bracket and the sliding body portion, the first barrier formed of a first material adhered to the bracket and in sliding contact with the sliding body portion, and a second barrier disposed between the bracket and the enclosure formed of a second material that provides a seal between the bracket and the enclosure. The first barrier and the second barrier cooperate to prevent passage of an agent from an external environment to the electrical switch.

In one aspect of the described embodiments, the first barrier provides a base line biasing force to the sliding body portion. In one embodiment, the base line biasing force directs the sliding body portion towards the enclosure and in so doing reduces a gap between the sliding body portion and the enclosure. The reduction in the gap reduces an amount of extraneous noise (such as rattling) generated by the electromechanical slide switch during use.

In another aspect of the described embodiments, the first barrier provides an enhanced counter-biasing force to the sliding body portion in response to a force externally applied to the sliding body portion. In one embodiment, the externally applied force can take the form of pressure applied to the sliding body portion when the electromechanical slide switch is immersed to a depth in water, the force being commensurate with water pressure at the depth. The counter biasing force can enhance an intrusion seal at the sliding body portion and first barrier interface that in combination with the second barrier renders the electromechanical slide switch water resistant.

In another aspect of the described embodiments, the enclosure, the sliding body portion and the first barrier can each be formed of conductive material. In this way, a conductive path can be formed that shields the electrical switch from an electrical discharge.

In another embodiment, a consumer electronic product is described. The consumer electronic product can include at least a housing configured to enclose and support a plurality of operational components and includes at least one opening. The consumer electronic product can also include an electromechanical slide switch assembly secured to the housing with a bracket. The electromechanical slide switch assembly can, in turn, include an external button feature disposed in the opening and configured to receive a sliding force, a sliding body portion mechanically coupled to the external button feature at a first surface, and an arm mechanically coupled to the sliding body portion at a second surface opposite the first surface. The arm is mechanically connected to an electrical switch and is configured to transfer at least some of the sliding force from the external button feature to the electrical switch. In this embodiment, the electrical switch alters a connection state of an electrical contact in response to the sliding force that in turn is a signal to at least one of the plurality of operational components. The electromechanical slide switch also includes a plurality of cooperating barriers configured to prevent an external agent from reaching the electrical switch.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF SELECTED EMBODIMENTS

Figure 1:
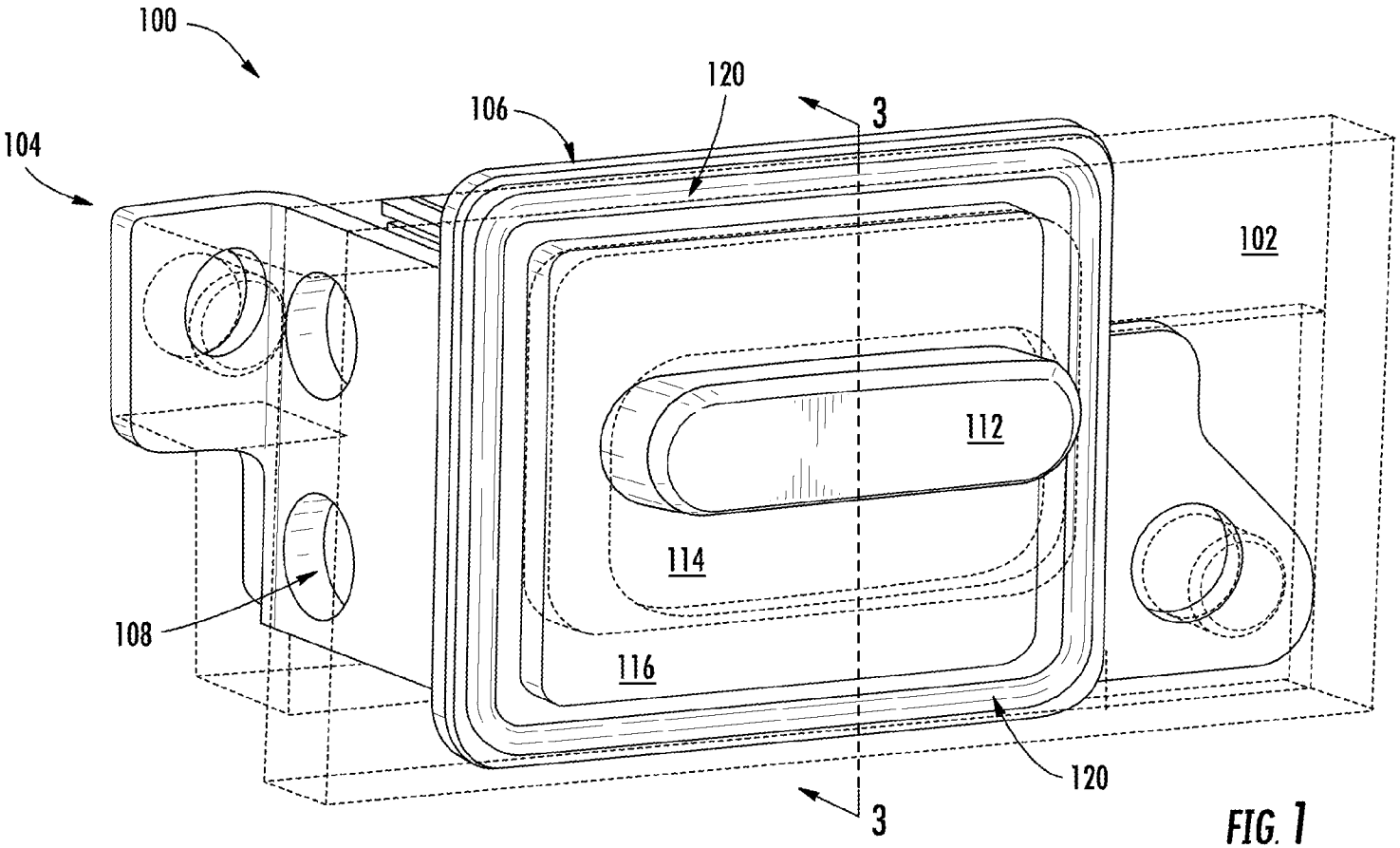
FIG. 1 is a side view of a cross section of an electromechanical slide switch assembly in accordance with the described embodiments.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

Broadly speaking, the embodiments disclosed herein describe an electromechanical slide switch well suited for use in electronic devices, such as laptops, cellphones, netbook computers, portable media players and tablet computers. In more detail, the embodiments describe an electromechanical slide switch that inhibits the intrusion of water, or other agents such as dust, from an external environment into areas that house sensitive electrical components, such as an electrical switch. The intrusion of water can cause immediate system failures due to shorts or more long term problems due to corrosion of electrical contacts. Moreover, the moisture resistance of the electromechanical slide switch can be maintained when the electromechanical slide switch is immersed to a depth in water.

In more detail, an electromechanical slide switch can include an external feature such as a button attached to sliding body portion. At least a portion of the button can be accessible and receive a sliding force that can be transferred from the button to the sliding body portion. The sliding body portion can be mechanically coupled to an electrical switch by way of an arm. In this way, any force applied to the button (by a user, for example) can be transferred via the sliding body portion to the arm that, in turn, result in a change in position of an electrical contact within the electrical switch. The change in position of the electrical contact can alter a connection state of the electrical switch that can result in a change in an operating state of any electrical circuits electrically connected thereto. In one embodiment, the electrical switch can include conductive pads that can be used to make suitable electrical connections. The conductive pads can be susceptible to moisture intrusion that can result in electrical shorting or more long term moisture related corrosion either of which can cause a faulty system operation.

In one embodiment, the electromechanical slide switch can include at least a first barrier and a second barrier that cooperate to prevent an external agent, such as water or dust, from penetrating the electromechanical slide switch and reaching the electric switch. In this way, system failures due to shorts or corrosion due to the intrusion can be eliminated. In one embodiment, the first barrier is attached to the enclosure using pressure sensitive adhesive (PSA) and in sliding contact with the sliding body portion. The first barrier can be formed of a resilient material (such as pre-compressed closed cell foam) that tends to maintain an original shape and as a result provides a baseline biasing force on the sliding body portion. The baseline biasing force can enhance an ability of the first barrier to resist the passage of the external agent as well as provide a measure of offset control by reducing a gap between the sliding body portion and the enclosure. In one embodiment, the first barrier, the sliding body portion and the enclosure can be conductive. For example, the first barrier can be impregnated with conductive elements. The first barrier can be adhered to the enclosure using a pressure sensitive adhesive (PSA) that in some cases can be conductive that can be used to provide a conductive path that can shield sensitive electrical components from an electrical discharge.

In the embodiments discussed herein, an electromechanical slide switch is shown and described with respect to FIGS. 1-4. The electromechanical slide switch can provide enhanced protection of sensitive electrical components from moisture even while immersed in water at depth. The electromechanical slide switch can also enhance an aesthetic appeal of an electronic device by preventing the generation of extraneous noise (such as rattling) during use due in part to active offset control, the look and feel of a consumer product that uses the electromechanical slid switch can be enhanced. The active offset control can provide a user with a more robust user experience since any extraneous noise, such as rattling, can be effectively eliminated. Furthermore, the electromechanical slide switch can provide the user with a more consistent sliding action that can be associated with a superior build quality.

FIG. 1 shows a front external view of electromechanical slide switch assembly 100 in accordance with the described embodiments. Slide switch assembly 100 can mounted within enclosure 102 (shown as semi-opaque for clarity) using bracket 104. Bracket 104 can have bracket face 106 and a number of mounting features 108 that can be used in conjunction with a fastener to secure electromechanical slide switch assembly 100 to enclosure 102. Enclosure 102 can be part of an electronic device, such as a consumer electronic product along the lines of an iPhone manufactured by Apple Inc. of Cupertino, Calif. Bracket face 106 can include opening 110 shown in FIG. 2 having a size and shape that can accommodate a multiple position external button feature in the form of slide button 112. Slide button 112 can be attached to (or formed together with) sliding body portion 114. The position of the slide button 112 can be adjusted to provide different signals used to control the operation of an electronic device such as that shown and described below with respect to FIG. 4. For example, slide button 112 can take many forms such as a two, three or more position button. When configured as a two position switch, slide button 112 can have a first and second position that can be used to unambiguously set a connection state for an electrical switch connected thereto. In those cases, however, where slide button 112 is configured as a three or more position button, a quick and unambiguous position indication of slide button 112 can take the form of distinctive visual indicia such as a colored label, printing, and so on that can be used to identify a current position of slide button 112. Therefore, maintaining a smooth sliding action for sliding body portion 114 can be important in those cases where the difference between positions of slide button 112 can be small. For example, if slide button 112 is configured as a three position switch, the amount of movement of slide button 112 between a first position, a second position, and a third position can be quite small and any "stickiness" experienced by sliding body portion 114 can cause an incorrect transition between positions. Therefore, preserving a smooth sliding action of sliding body portion 114 (and slide button 112) can be an important consideration in a user's overall experience with the consumer electronic product.

Figure 2:
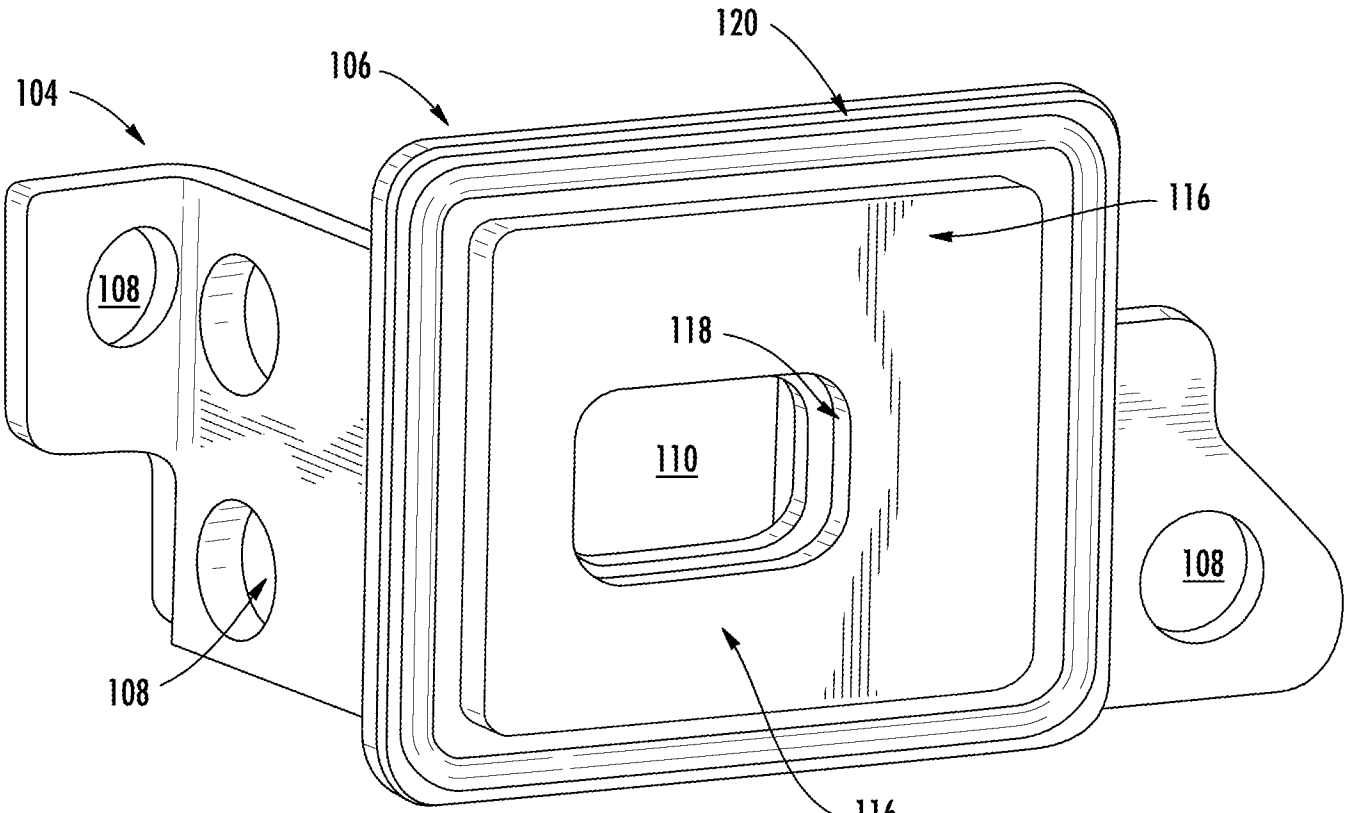
FIG. 2 is front perspective view of a bracket assembly illustrating a relationship with a first barrier and a second barrier in accordance with the described embodiments.

In order to preserve the smooth sliding action of sliding body portion 114 and to help prevent intrusion of external agents (such as dust or water), electromechanical slide switch assembly 100 can include a number of intrusion barriers. The intrusion barriers can prevent passage of external agents as well as preserve the smooth sliding action of sliding body portion 114. For example, as shown in FIG. 2, first barrier 116 can include opening 118 having a size and shape in accordance with the dimensions of slide button 112 and opening 110. In this way, slide button 112 can be snugly fit within opening 118 leaving little or no gap around slide button 112 that allows the passage of, for example, moisture or dust. First barrier 116 can be attached directly to bracket face 106 using any number and type of adhesives, such as a pressure sensitive adhesive, or PSA. It should be noted that the adhesive can be conductive or non-conductive depending upon the particular implementation. In one embodiment, first barrier 116 can be formed of a material, such as closed cell foam, that does not readily absorb moisture and does not impede the smooth sliding action of sliding body portion 114. In this way, first barrier 116 can be directly attached to bracket face 106 in such a way that first barrier 116 can prevent passage of moisture or dust along a first intrusion path that can include openings 110 and 118 regardless of a current position of sliding body portion 114 and slide button 112.

Second barrier 120 can be configured to prevent passage of moisture or dust along a second intrusion path. In the described embodiments, the second intrusion path is blocked by completing a seal around slide button 112 and first barrier 116 such that regardless of the position of slide button 112 or sliding body portion 114, there is no path between the external environment and an interior of housing 102. In this way, first barrier 116 and second barrier 120 cooperate with each other to prevent intrusion of moisture or dust into the interior of enclosure 102. In the described embodiment, second barrier 120 can take the form a gasket like structure around a perimeter of bracket face 106. In this way, second barrier 120 can cooperate with first barrier 116 to prevent the passage of moisture or dust from the external environment to the interior of enclosure 102. Since second barrier 120 does not directly interface with sliding button 112 or sliding body portion 114, second barrier 120 is not required to preserve the sliding action of sliding body portion 114 (as is first barrier 116). Therefore, second barrier 120 can be formed of more rugged and resilient material such as silicone. In one embodiment, second barrier 120 can be formed of silicone that is overmolded onto bracket face 106. In this way, bracket 104 can be secured to housing 102 in such a way that second barrier 120 functions as a gasket between enclosure 102 and bracket face 106 effectively sealing off any intrusion paths between bracket 104 and enclosure 102.

Figure 3:
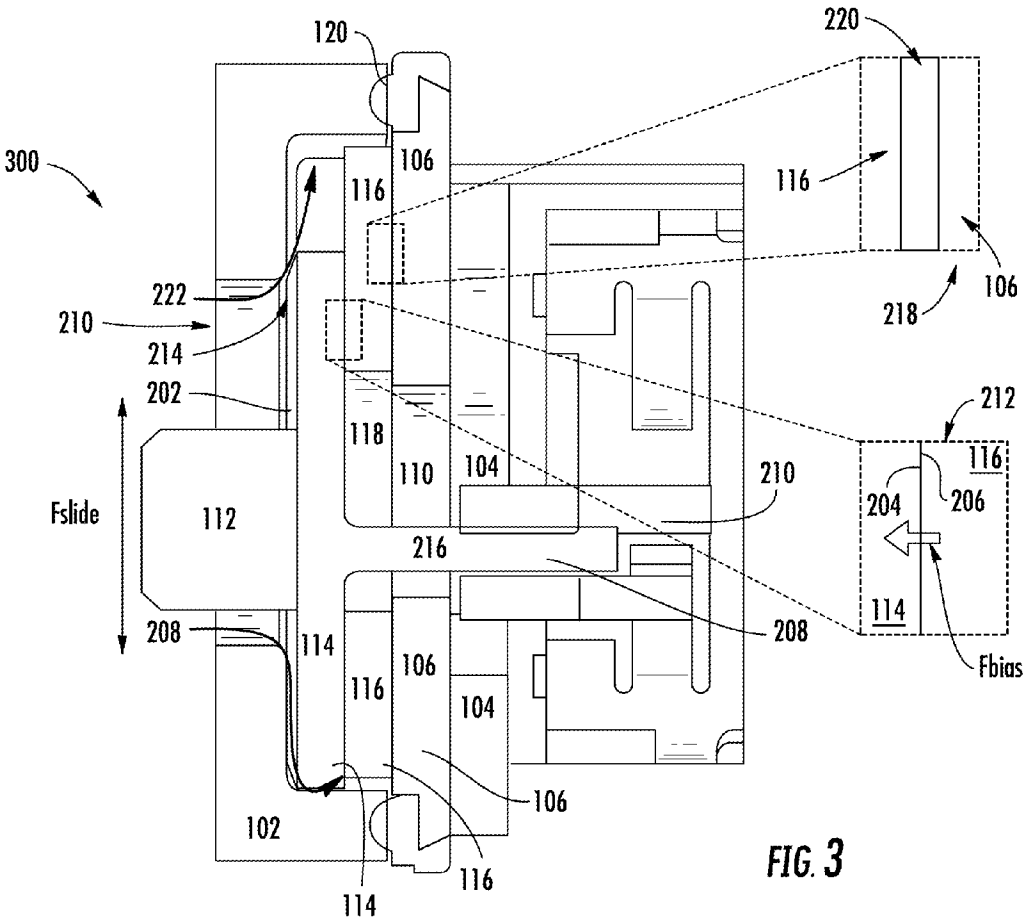
FIG. 3 shows a representation of an electromechanical slide switch assembly attached to an enclosure of a consumer electronic product by way of the bracket assembly of FIG. 2.

FIG. 3 shows cross sectional view 300 of electromechanical slide switch assembly 100 along line A-A in accordance with the described embodiments. Electromechanical slide switch assembly 100 can include slide button 112 mechanically coupled at first surface 202 of sliding body portion 114. Second surface 204 of sliding body portion 114 can be in sliding contact with first surface 206 of first barrier 116. In this way, first barrier 116 can block first intrusion path 208 (that includes enclosure opening 210 and bracket opening 110) regardless of a current position of sliding body portion 114. For example, as sliding body portion 114 is moves upward or downward by the imposition of sliding force $F_{slide}$ on slide button 112, any direct connection between enclosure opening 210 and opening 110 is blocked thereby preventing any passage of moisture or other agents along first intrusion path 208 towards electrical switch 210. It should be noted that although interface 204/206 is shown as planar, it can nonetheless take any form appropriate. For example, in some cases, first barrier 116 can be ribbed in that second surface 204 can take on a ribbed appearance.

In some embodiments, first barrier 116 can be formed of material (such as pre-compressed closed cell foam) that has a property of retaining an original shape due in part to being pre-compressed prior to installation. The pre-compression energy stored in the material that goes into fabricating first barrier 116 can be expressed as baseline biasing force $F_{bias}$ (shown in insert 212). Baseline biasing force $F_{bias}$ can cause sliding body portion 114 to move towards enclosure 102 thereby reducing gap 214 between enclosure 102 and surface 202 of sliding body portion 114. The reduction in gap 214 (as well as preserving gap 214 within a nominal range) can provide offset control by which it is meant that gap 214 is maintained within a pre-determined range reducing variations brought about by normal wear and tear, manufacturing tolerances, and so on. This offset control can reduce the production of extraneous noise (such as rattling) as well as provide a "tight" feeling consistent with a well made product, all of which contributes to an overall positive user experience.

It should also be noted that when an external force is applied to sliding body portion 114, first barrier 116 can react by providing a counter biasing force that at least partially offsets the applied force. In this way, the integrity of first barrier 116 can be maintained. For example, when electromechanical slide switch 100 is immersed in water to a depth, the weight of the water at the depth (expressed as water pressure) can cause an external force to be applied to sliding body portion 114 that can be related to an area exposed to the water pressure. This external force can be at least partially offset by the counter biasing force provided by first barrier 116. In this way, the integrity of first barrier 116 and therefore its ability to block first intrusion path 208 can be maintained. Accordingly, electromechanical slide switch 100 can provide a measure of water resistance even while submerged at depth.

Arm 216 can be formed with or otherwise mechanically coupled to sliding body portion 114. Arm 216 can engage electrical switch 210 in such a way that sliding force $F_{slide}$ applied to sliding button 112 can be transferred directly through sliding body portion 114 and arm 216 to electrical switch 210. In this way, sliding force $F_{slide}$ can cause electrical switch 210 to alter a connection state of conductive pads included within electrical switch 210. The change in the connection state of electrical switch 210 can send a signal to electrical components connected thereto. The signal can cause a change in an operating state of those or other operational components. Therefore, the nature of the sliding contact between surfaces 204 and 206 can dictate the ease of switching electrical switch 210. For example, if the nature of the sliding contact between surfaces 204 and 206 is "sticky" then it may be difficult to move sliding body portion 114 smoothly from one position to another. In those situations where electromechanical slide switch assembly 100 is used in a small form factor electronic device, this stickiness can make changing the connection state of electrical switch 210 difficult, especially if there are more than two possible connections states (as in a hold switch).

Generally, first barrier 116 can be adhered to bracket face 106 using any suitable adhesive. For example, as shown in insert 218, first barrier 116 can be adhered to bracket face 106 using pressure sensitive adhesive (PSA) 220. In one embodiment, PSA 220 can be conductive in nature by which it is meant PSA 220 can conduct electricity fairly easily. In those situations where slide button 112, sliding body portion 114 and first barrier 116 are also conductive, then any electrical charge can be directed to bracket face 106 that can be part of a chassis ground formed by enclosure 102 in those cases where enclosure 102 is also conductive (such as an aluminum enclosure). In this way, electrical switch 210 can be protected from electrical discharge events.

Since second barrier 120 does not interact directly with sliding body portion 114, there is no need to select materials that go into forming second barrier 120 that facilitate easy sliding action. Therefore, second barrier 120 can be formed of more durable material than would be generally contemplated for first barrier 116. For example, second barrier 120 can be formed of silicone that can be over-molded onto bracket face 106. The nature of silicone is such that when bracket 104 is secured to enclosure 102, bracket 104 can be brought into tight association with enclosure 102. This tight association between enclosure 102 and bracket 104 can cause second barrier 120 to compress in such a way as to function as a gasket between enclosure 102 and bracket face 106. In this way, second intrusion path 222 can be effectively blocked regardless of the current position of sliding body portion 114.

Figure 4:
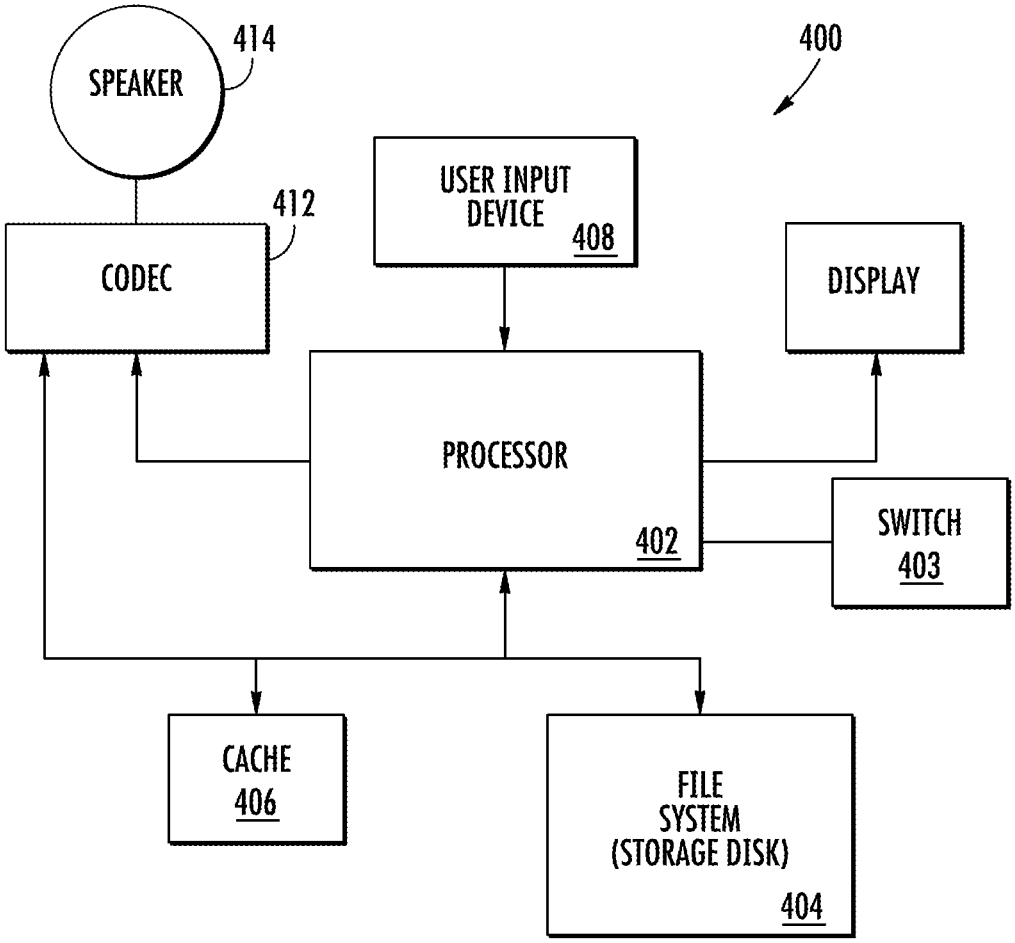
FIG. 4 shows representative consumer electronic product in accordance with the described embodiments.

FIG. 4 is a block diagram of a media player 400 in accordance with the described embodiments. The media player 400 can include a processor 402 that pertains to a microprocessor or controller for controlling the overall operation of the media player 400. The processor 402 can receive control signals from various switches 403, such as the multi-position slide switch 100 described with respect to FIGS. 1-3. Based upon the received control signal, the processor 402 can operate the device 400 in accordance with the signal.

The media player 400 can store media data pertaining to media items in a file system 404 and a cache 406. The file system 404 can, typically, be a storage disk or a plurality of disks or a solid-state storage device, such as flash memory. The file system can provide high capacity storage capability for the media player 400. However, since the access time to the file system 404 can be relatively slow, the media player 400 also can include a cache 406. The cache 406 can be, for example, Random-Access Memory (RAM) provided by semiconductor memory. The relative access time to the cache 406 can be substantially shorter than for the file system 404. However, the cache 406 may not have the large storage capacity of the file system 404. Further, the file system 404, when active, can consume more power than does the cache 406. The power consumption can be particularly important when the media player 400 is a portable media player that is powered by a battery (not shown).

The media player 400 can also include a user input device 408 that allows a user of the media player 400 to interact with the media player 400. For example, the user input device 408 can take a variety of forms, such as a button, keypad, dial, etc. Still further, the media player 400 includes a display 410 (screen display) that can be controlled by the processor 402 to display information to the user. A data bus 411 can facilitate data transfer between at least the file system 404, the cache 406, the processor 402, and the CODEC 412.

In one embodiment, the media player 400 can store a plurality of media items (e.g., songs, video files and podcasts) in the file system 404. When a user desires to have the media player play a particular media item, a list of available media items is displayed on the display 410. Then, using the user input device 408, a user can select one of the available media items. The processor 402, upon receiving a selection of a particular media item, can supply the media data for the particular media item to a coder/decoder (CODEC) 412. The CODEC 412 can then produce analog output signals for a speaker 414. For a video based media item, a video CODEC can be utilized to output video images to the display 410. The speaker 414 can be a speaker internal to the media player 400 or external to the media player 400. For example, headphones or earphones that connect to the media player 400 would be considered an external speaker.

The various aspects, embodiments, implementations or features of the described embodiments can be used separately or in any combination. Many features and advantages of the present invention are apparent from the written description and, thus, it is intended by the appended claims to cover all such features and advantages of the invention. Further, since numerous modifications and changes will readily occur to those skilled in the art, the invention should not be limited to the exact construction and operation as illustrated and described. Hence, all suitable modifications and equivalents may be resorted to as falling within the scope of the invention.

What is claimed is:

1. A electromechanical slide switch, comprising:

a sliding body portion comprising an external button feature configured to receive a sliding force that is transferred to the sliding body portion, the sliding body portion coupled to an electrical switch having an electrical contact that completes an electrical connection in a first position and breaks the electrical connection in a second position in response the sliding force, the sliding body portion and the electrical switch secured to an enclosure wall by a bracket;

a first barrier disposed between the bracket and the sliding body portion, the first barrier formed of a first material and adhered to the bracket and in sliding contact with the sliding body portion; and a second barrier disposed between the bracket and the enclosure wall formed of a second material, wherein the first barrier and the second barrier cooperate to prevent passage of an agent between an external environment and the electrical switch.

2. The electromechanical slide switch as recited in claim 1, wherein the first barrier is adhered to the bracket using pressure sensitive adhesive.

3. The electromechanical slide switch as recited in claim 2, wherein the first barrier applies a baseline biasing force on the sliding body portion.

4. The electromechanical slide switch as recited in claim 3, wherein the baseline biasing force provides offset control for the electromechanical slide switch by reducing a gap between the enclosure wall and the sliding body portion.

5. The electromechanical slide switch as recited in claim 4, wherein the reduced gap renders the electromechanical slide switch robust against generating extraneous noise during use.

6. The electromechanical slide switch as recited in claim 5, wherein the first barrier applies a counter-biasing force on the sliding body portion commensurate with an external force applied to the sliding body portion, the counter-biasing force being greater than the baseline biasing force and in proportion to the applied external force.

7. The electromechanical slide switch as recited in claim 6, wherein the counter-biasing force increases an ability of the first barrier to prevent the passage of the agent from the external environment to the electrical switch.

8. The electromechanical slide switch as recited in claim 7, wherein when the electromechanical slide switch is immersed to a depth in water, the external force applied to the sliding body portion is proportional to water pressure at the immersion depth.

9. The electromechanical slide switch as recited in claim 8, wherein the counter-biasing force applied by the first barrier in combination with the second barrier render the electromechanical slide switch effectively water resistant at the immersion depth.

10. The electromechanical slide switch as recited in claim 9, wherein the first barrier and the second barrier cooperate with each other to reduce an impact load experienced by the electromechanical slide switch during an impact event.

11. The electromechanical slide switch as recited in claim 10, wherein a surface of the first barrier in contact with the sliding body portion is ribbed to enhance a response of the first barrier to the application of the external force on the sliding body portion.

12. The electromechanical slide switch as recited in claim 1, wherein the first material is closed cell foam.

13. The electromechanical slide switch as recited in claim 12, wherein second barrier surrounds the first barrier.

14. The electromechanical slide switch as recited in claim 13, wherein second barrier is formed of silicone that is over-molded.

15. The electromechanical slide switch as recited in claim 14, wherein the enclosure wall is formed of metal.

16. The electromechanical slide switch as recited in claim 15, wherein the electromechanical slide switch is incorporated into an electronic device and wherein at least a portion of the external button feature protrudes from the enclosure wall.

17. The electromechanical slide switch as recited in claim 16, wherein the external button feature and the sliding body portion are each formed of conductive material.

18. The electromechanical slide switch as recited in claim 17, wherein the first material is conductive and adhered to the conductive sliding body using conductive adhesive.

19. The electromechanical slide switch as recited in claim 18, wherein a conductive path is formed between the metal enclosure wall and the conductive external button feature, the conductive path preventing electrical discharge from reaching the electrical switch.

20. A consumer electronic product, comprising:

a housing configured to enclose and support a plurality of operational components, wherein the housing includes at least one opening; and an electromechanical slide switch assembly secured to the housing with a bracket, the electromechanical slide switch assembly comprising:

an external button feature disposed in the opening and configured to receive a sliding force, a sliding body portion mechanically coupled to the external button feature at a first surface, an arm mechanically coupled to the sliding body portion at a second surface opposite the first surface, the arm mechanically connected to an electrical switch, the arm configured to transfer at least some of the sliding force from the external button feature to the electrical switch, the electrical switch being configured to change a connection state of an electrical contact in response to the sliding force, the change in connection state being a signal to at least one of the plurality of operational components, and a plurality of cooperating barriers configured to prevent an external agent from reaching the electrical switch.

21. The consumer electronic product as recited in claim 20, the plurality of cooperating barriers comprising:

a first barrier disposed between the bracket and the second surface of the sliding body portion, the first barrier formed of a first material adhered to the bracket and in sliding contact with the second surface of the sliding body portion; and a second barrier disposed between the bracket and the housing formed of a second material that functions as a gasket that prevents passage of the external agent.

22. The consumer electronic product as recited in claim 21, wherein the first barrier is formed of closed cell foam and is adhered to the bracket using pressure sensitive adhesive, and wherein the first barrier applies a baseline biasing force on the sliding body portion, the baseline biasing force providing offset control for the electromechanical slide switch by reducing a gap between a wall of the housing and the sliding body portion.

23. The consumer electronic product as recited in claim 22, wherein the second barrier surrounds the first barrier and is formed of silicone that is over-molded.

* * * * *